US010118314B1

(12) United States Patent
Robbins

(10) Patent No.: US 10,118,314 B1
(45) Date of Patent: Nov. 6, 2018

(54) FIBER BOXES FOR A CONCRETE FIBER INJECTOR

(71) Applicant: Mark D. Robbins, Kingsland, TX (US)

(72) Inventor: Mark D. Robbins, Kingsland, TX (US)

( * ) Notice: Subject to any disclaimer, the term of this patent is extended or adjusted under 35 U.S.C. 154(b) by 0 days.

(21) Appl. No.: 15/911,089

(22) Filed: Mar. 3, 2018

(51) Int. Cl.
*B28C 5/00* (2006.01)
*B28C 5/40* (2006.01)
*B28C 7/12* (2006.01)
*B28C 7/16* (2006.01)

(52) U.S. Cl.
CPC ..... *B28C 5/40* (2013.01); *B28C 7/128* (2013.01); *B28C 7/161* (2013.01)

(58) Field of Classification Search
CPC .. B28C 5/40; B65H 5/40; B65H 2301/41524; B65H 2553/20; E04C 5/073
USPC ..... 222/129
See application file for complete search history.

(56) References Cited

U.S. PATENT DOCUMENTS

| | | | |
|---|---|---|---|
| 937,868 | A | 10/1909 | Rosenleaf |
| 2,533,852 | A | 12/1950 | Tietig |
| 2,550,354 | A | 4/1951 | Jacobsen |
| 2,964,244 | A | 12/1960 | Pennington |
| 3,222,149 | A | 12/1965 | Drummond |
| 3,290,197 | A | 12/1966 | Carmody |
| 3,453,356 | A | 7/1969 | Kent, Jr. et al. |
| 3,533,884 | A | 10/1970 | Quackenbush |
| 4,023,779 | A | 5/1977 | Beloy |
| 4,183,724 | A | 1/1980 | Larive |
| 5,328,493 | A | 7/1994 | Roncato et al. |
| 5,437,827 | A | 8/1995 | Marx |
| 5,830,304 | A | 11/1998 | Priesnitz et al. |
| 5,931,610 | A | 8/1999 | Rixom |
| 7,228,990 | B2 | 6/2007 | Schmidt |
| 8,677,720 | B2 | 3/2014 | Carson et al. |
| 8,827,085 | B2 | 9/2014 | Seo et al. |

(Continued)

FOREIGN PATENT DOCUMENTS

EP 0438745 A1 7/1991

OTHER PUBLICATIONS

Omar Faruk, et al, Bicomposites Reinforced With Natural Fibers: 2000-2010, Progress in Polymer Science 37 (2012)1552-1596, Published by Elsevier Ltd., (journal home page: www.elsevier.com/locate/ppolysci), (Accessed at: https://www.researchgate.net/publication/256923037_Biocomposites_reinforced_with_natural_fibers_2000-2010).

*Primary Examiner* — Tony G Soohoo
*Assistant Examiner* — Anshu Bhatia
(74) *Attorney, Agent, or Firm* — Mark W Handley; Handley Law Firm, PLLC

(57) ABSTRACT

The fiber boxes (60) each contain fiber (62) and are removably mounted to a fiber injector (9) for injecting the fiber (62) into a material flow stream. The fiber boxes (60) each have an enclosure (61) for containing the fiber (62), preferably a single fiber (62). An aperture 70 provides a feed hole (70) for passing the fiber (62) from an interior of the enclosure (61) to an exterior of the enclosure (61). Contacts (64) having ends disposed on an exterior of the enclosure (61), spaced apart for registering with mating contacts (54) on a fiber distribution ring (40). A frangible element (68) extends between the contacts (64) and provides electrical continuity between the two contacts (64), such that when the fiber (62) is fully withdrawn from within the enclosure (61) the frangible element (68) separates and breaks electrical continuity between the two contacts (64).

20 Claims, 9 Drawing Sheets

(56) References Cited

U.S. PATENT DOCUMENTS

| | | | | |
|---|---|---|---|---|
| 2004/0255429 | A1 | 12/2004 | Clausen | |
| 2006/0070676 | A1 | 4/2006 | Blackmore, Jr. | |
| 2006/0087910 | A1* | 4/2006 | Knepp | B28C 5/404 366/1 |
| 2012/0192766 | A1 | 2/2012 | Ferraiolo | |

* cited by examiner

FIBER BOXES FOR A CONCRETE FIBER INJECTOR

CROSS-REFERENCE TO RELATED APPLICATION

The present application is related as a divisional and continuation-in-part application to U.S. Pat. No. 9,963,318, issued May 8, 2018, entitled "CONCRETE FIBER INJECTOR," having application Ser. No. 15/676,546 filed Aug. 14, 2017, and invented by Mark D. Robbins.

TECHNICAL FIELD OF THE INVENTION

The present invention relates in general to concrete and enhancing the strength and versatility of concrete as used in various applications by allowing the controlled and quantified placement of various materials into a concrete delivery stream.

BACKGROUND OF THE INVENTION

The current style of placing concrete on a job site quite often uses a concrete pump, either a boom truck or a smaller trailered pump. Being able to use a pump to deliver the concrete aggregate some distance from the delivery truck, place it directly where it is needed without the manual labor of a wheel barrow, has significantly enhanced the productivity and efficiency of the concrete industry for all but the smallest jobs. The larger the job, the more is gained from using the larger boom trucks.

One thing that has not changed is lack of tensile strength for concrete. From stone aggregates to fiber, steel, and various other additions to the concrete mixture, many things have been tried to enhance the tensile strength of the concrete.

This period of time in history is marked by rapid advances in material science. For one example, the advancing science of graphene and carbon nanotubules, the strongest material ever manipulated by man, is sure to have significant effects in every kind of industry due to its strength and conductive properties. For example, steel was a commonly used structural material similar to those used at the beginning of the twentieth century such as ASTM A36 steel which has a tensile strength of 550 MPa. These days in the beginning of the twenty-first century carbon fiber materials have been developed such as graphene which has a tensile strength of 130,000 MPa.

The present invention advances the science of structural concrete by leveraging the use of concrete delivery systems and fibers, of various types, to uniformly embed materials of high tensile strength in the concrete aggregate. As used in this document, the term "fiber" refers to any of the following: titanium wire, copper wire, carbon nanotubules, braided graphene or any other natural or man-made substance. In addition, the invention allows the inclusion, if necessary, of conductive fibers, for example copper, or conductive carbon fibers, to create an electromagnetic wave barrier to enable creation of a Faraday Cage to exclude electromagnetic radiation. As computer security becomes more necessary, this capability will become more important.

While this document specifically describes the inclusion of various materials into a concrete stream, the method is not limited to concrete but can be applied to any material stream.

SUMMARY OF THE INVENTION

A fixed attachment according to the present disclosure comprises three main parts which are appended to the end of a concrete pump boom nozzle or the end of a concrete truck delivery trough. A fixed attachment is rigidly attached to the end of the boom nozzle in stationary relation therewith. The fixed attachment has a control handle which is used both to control the location of an end of the boom nozzle for concrete placement at the site and to control the distribution pattern of fibers via an electric motor. A rotary attachment is rotatably secured to a lower end of the fixed attachment. The rotary attachment is rotated by an electric motor. A fiber distribution ring is removably secured to the lower end of the rotary attachment and may be rapidly detached from and rapidly reattached to the rotary attachment. The fiber distribution ring has a number of fiber box holders which are reloaded repeatedly after each delivery, for example one concrete truck, with fiber boxes. The fiber boxes are boxed containers of the fiber being injected into the concrete stream. A fiber brake is a sleeve moveably disposed between the fixed attachment and the rotary attachment for selectively moving to cover fiber delivery apertures in the fiber distribution ring to control whether fiber is passing into material flowing through the boom or nozzle.

In essence, this device allows the addition of tensile enhancing materials into monolithic slabs which is essentially independent of the actual concrete mixture and its strength, adding additional properties, like EM shielding, without hampering the delivery efficiency of the concrete at the site.

The fiber boxes are secured to a fiber injector for passing fibers into a material. The fiber boxes each include an enclosure for containing one of the fibers for passing into the material flow, an aperture providing a feed hole for passing a one of the fibers from an interior of the enclosure to an exterior of the enclosure, and two contacts having ends disposed on an exterior of the enclosure, the ends being spaced apart for registering with mating contacts. A frangible element extends between the two contacts, the frangible element being conductive for providing electrical continuity between the two contacts. A second end of the fiber being secured to the frangible element, such that when all the fiber has been streamed into the material, the end is pulled free breaking the frangible conductor and breaking electrical continuity between the two contacts.

The fiber boxes further include a fiber install tab secured to the first end of the fibers, and sized for fitting through a fiber delivery aperture extending into the fiber injector and the material flow. An angled lower end is provided on the enclosure for cooperatively engaging with an angled interior surface for urging the two contacts to electrically engage with two mating contacts. The two contacts are disposed at a lower portion of a first vertically extending exterior surface of the fiber box. The aperture providing the feed hole is disposed on an upper portion of the vertically extending exterior surface of the fiber box.

DESCRIPTION OF THE DRAWINGS

For a more complete understanding of the present invention and the advantages thereof, reference is now made to the following description taken in conjunction with the accompanying Drawings in which

FIG. 1 is a perspective view of the fiber injector;

FIG. 2 is an exploded view of the fiber injector

FIG. 3 is a partial section view of the fiber distribution ring, a fiber box holder and a fiber box, taken along section line 3-3 of FIG. 1;

FIG. 4 is a perspective view of the fiber box;

FIGS. 5, 6 and 7 are longitudinal section views of the fiber injector, taken along section line 3-3 of FIG. 1, and show operation of the control handle for manually controlling operation of the fiber injector;

FIG. 8 is a partial exploded view showing mounting of the fiber distribution ring to the rotary attachment;

FIG. 9 is a partial perspective view showing a rapid attachment release connector for releasibly locking the fiber distribution ring to the rotary attachment;

FIG. 10 is a partial section view showing mounting of the fiber distribution ring to the rotary attachment, as viewed along the section line 10-10 of FIG. 8; and FIG. 11 is a partial section view of the fiber distribution ring mounted to the rotary attachment, as viewed along the section line 10-10 of FIG. 8.

FIG. 12 is a perspective view of a second fiber box having electric contacts disposed on an outward surface at an upward end of the second fiber box;

FIG. 13 is a partially exploded, perspective view of a third fiber box having multiple frangible conductors connected to external electric contacts disposed at an outward surface of the third fiber box;

FIG. 14 is a partially exploded, perspective view of a fourth fiber box having multiple frangible conductors connected to external electric contacts disposed at an outward surface of the third fiber box;

FIG. 15 is a sectional view of a fiber reel and the fourth fiber box taken along section line 15-15, and showing the reel located within the fourth fiber box and a plurality of frangible conductors dividing sections of wound fiber mounted to the fiber reel;

FIG. 16 is a layout plan view of a contact brush card for mounting in the fourth fiber box, showing conductive tracks printed onto a surface of the brush card;

FIG. 17 is a longitudinal section view of an alternative fixed attachment having a first interiorly disposed fixed impeller;

FIG. 18 is a sectional view of the alternative fixed attachment taken along section line 18-18 of FIG. 17;

FIG. 19 is a longitudinal section view of an alternative fiber distribution ring having a second interiorly disposed fixed impeller;

FIG. 20 is a partial section view of an alternative fiber distribution ring, a fiber box holder and a fiber box, as would be viewed if taken along section line 3-3 of FIG. 1, and shows a countersunk interior surface with a scalloped region disposed around the fiber delivery apertures; and FIG. 21 is a side elevation view of an interior surface of the fiber box holder, showing the countersunk interior surface with the scalloped region disposed around the fiber delivery apertures.

DETAILED DESCRIPTION OF THE INVENTION

Figure 1:
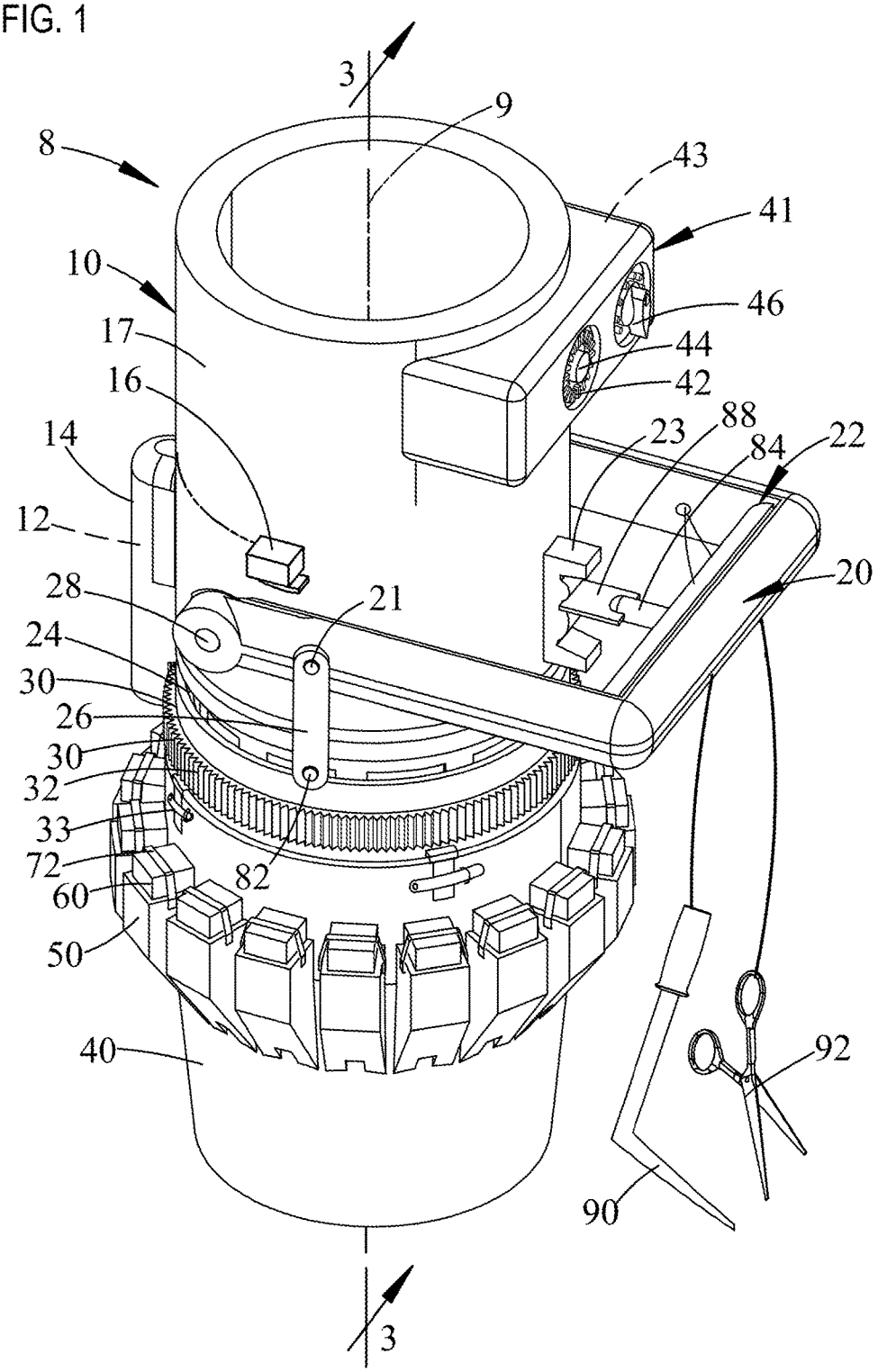
FIGS. 1 through 21 show various aspects for a concrete fiber injector made according to the present disclosure, as set forth below.
Figure 2:
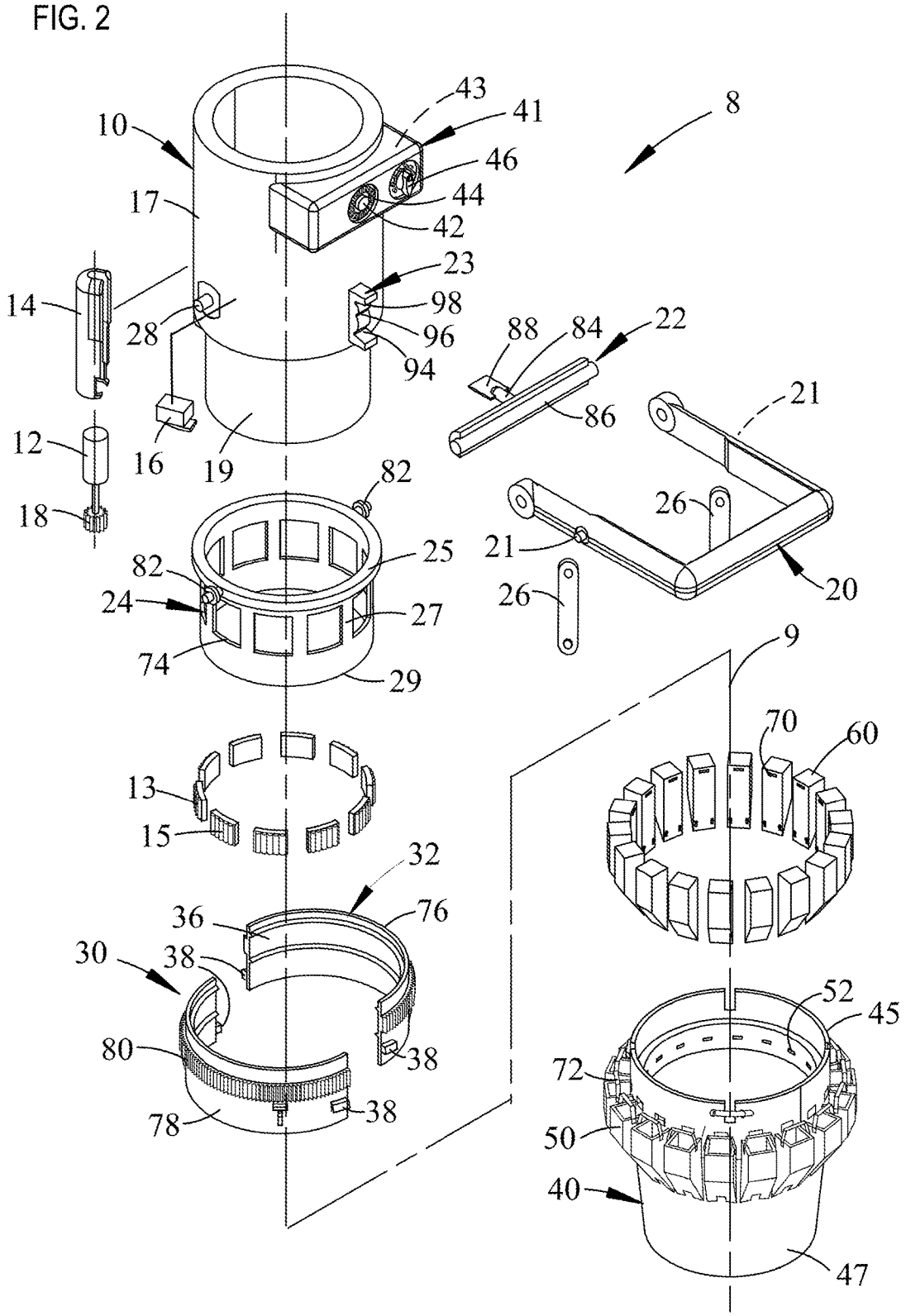

FIG. 1 is a perspective view and FIG. 2 is an exploded view of a fiber injector 8 for mounting to a boom end of a concrete pump. The fiber injector 8 is mounted to the boom or to the dump trough of a concrete truck and is used for injecting fibers 62 having tensile strength into a flow of concrete material passing from the boom or from the dump trough and through the fiber injector 8. This method and apparatus for injecting various materials into a particular stream is not limited to concrete, but may be used for injecting fibers into various material flow streams conveyed by a flow conductor, such as the boom or the dump trough of a concrete truck. A fiber gather tooth 90 is used to gather the fibers together and fiber shears 92 to cut through the fibers 62. The fiber gather tool 90 and the fiber shears 92 are hanging from the handle 20 are used to collect and then trim off the fibers 62 when pulling down on a control handle 20 to stop their streaming.

The fiber injector 8 has a longitudinal axis 9 and a fixed attachment 10 which is concentrically disposed with the longitudinal axis 9. The fixed attachment 10 is annular shaped and has an upper end 17 and a lower end 19. A fiber brake 24 is a cylindrical sleeve which is slidably mounted to a lower end of the fixed attachment 10. The fiber brake 24 is concentrically disposed around the longitudinal axis 9 and has a cylindrical shaped body 27, a lower terminal end defining a lower rim 29 and an annular-shaped stop 25 which protrudes outward from an upper end of the cylindrical shaped body 27. Two mounting pins 82 extend outward from the stop 25 on opposite sides of the fiber brake 24. A plurality of stanchion windows 74 are formed through the cylindrical shaped body 27 for passing stanchions 13. The stanchions have needle bearings 15 and are fixedly mounted to the lower end 19 of the fixed attachment 10 after the fiber brake 24 is aligned in position for permanently mounting to the fixed attachment 10.

The rotary attachment 30 is ring-shaped and rotatably mounted to the lower end 19 of the fixed attachment 10 concentric with the longitudinal axis 9. The rotary attachment 30 extends around an upper end of the fiber brake 24. The rotary attachment 30 is defined by a gear drive ring 32 having two gear ring halves 76 and 78 which are removably secured together with fasteners 38. The gear ring halves 76 and 78 each have exteriorly protruding gear teeth 80 to together define a cylindrical gear rack for engaging with the pinion gear 18. Two interiorly disposed protrusions extend from an inner surface of the gear drive ring 30 to define a bearing race 36 for fitting around the needle bearings 15, rotatably securing the rotary attachment to the lower end 19 of the fixed attachment 10. The rotary attachment 30 is mounted around the stanchions 13 and needle bearings 15 after the fiber brake sleeve 24 and its attendant brake actuator rod 26 are slid into position on the fixed attachment 10. Fasteners 38 allow the two halves 76 and 78 of the rotary attachment to be fastened around fixed attachment 10 supporting the part via the bearing race 36 which encases the bearing stanchions 13.

A fiber distribution ring 40 is annular shaped and has a cylindrical upper end 45 and a tapered lower end 47 which are concentrically disposed with the longitudinal axis 9. The cylindrical upper end of the ring 40 is mounted to the rotary attachment 30 for rotating therewith about the fixed attachment 10 and the fiber brake 24. The lower end 47 is tapered at a taper angle 49 to the vertical. (Shown in FIG. 5). Preferably the fiber brake 24 and the fiber distribution ring 40 are cooperatively configured such that a lower exterior rim 25 of the fiber brake 24 will, when the fiber brake 24 is moved to a downward position, engage an interior transition region 51 where the fiber distribution ring 40 transitions from the cylindrical upper end 45 to the tapered lower end 47. The transition region 51 is interiorly disposed within the fiber distribution ring 40 and engaged with the rim 25 of the fiber brake 24 to squeeze fibers 62 (shown in FIG. 4) there-between. (See also FIG. 5). A plurality of fiber box holders 50 are mounted circumferentially around an intermediate portion of the fiber distribution ring 40. Each of the fiber box holders 50 will hold a respective fiber box 60, with each of the fiber boxes 60 having one or more strands of fibers 62. The fiber boxes 60 are retained within the fiber box holders 60 by retainers 72, which are preferably provided by elastic straps. The fiber holders 50 and fiber boxes 60 are discussed in more detail below in reference to FIGS. 3 and 4. Fiber ring connector 33 allow the quick release/attachment of the fiber distribution ring 40, and are discussed below in reference to FIGS. 8-11.

A control handle 20 is preferably U-shaped and has two terminal ends which are pivotally mounted to a lower portion of the upper end 17 of the fixed attachment 10 by means of two pivot pins 28. The control handle 20 includes two mounting pins 21 which extend from opposite sides, offset from the two terminal ends, and are aligned for pivotally connecting respective ones of two brake actuator rods 26 which pivotally connect to the two mounting pins 82 protruding laterally outward and to the side of the stop 25 of the fiber brake 24. The brake actuator rods 26 provide links pivotally connecting from the two pins 21 to two mounting pins 82 extending outward from the annular shaped stop 35 of the upper terminal end of the fiber brake 24.

A handle lock set 22 is slidably mounted to the control handle 20 and includes an elongate grip bar 86 which fits into an interior portion of the hand grip portion of the control handle 20. A lock pin 84 extends from a central portion of the grip bar 86 and has a terminal end to which an insert tab 88 is mounted. The insert tab engages a lock positioner 23 which is mounted to a lower end of the upper portion 17 of the fixed attachment 10. The lock positioner 23 has three indentations formed into one side for providing detents 94, 96 and 98 for engaging with the insert tab 88 of the lock pin 88 to selectively position the control handle 20 in three selected positions rotated about the pins 28 and relative to the fixed attachment 10. Each detents 94, 96 and 98 are configured in cooperative relation with the control handle 20 and the brake actuator rods 26 to selectively position the fiber brake 24 in the three respective positions shown in FIGS. 5, 6 and 7, and discussed below.

A switch 16 is preferably provided by a proximity switch which detects when the control handle 20 is angularly moved about the pin 28 to be disposed in the upper angular position shown in FIG. 7, which is discussed below. The switch 16 may be of the type which is magnetically actuated, optically actuated, or be a micro-switch of the type shown in FIGS. 1 and 2 having an arm which is engaged directly by the control arm 20 to throw and make or break electric contacts. Actuating the switch 16 preferably powers the motor 12, which is preferably electric. Powering the motor 12 rotates the pinion drive gear 18 which engages the gears 80 of the rotary attachment 30, which rotates the rotary attachment 30 and the fiber distribution ring 40 around the longitudinal axis 9. The motor 12 and the pinion gear 18 are mounted within a housing 14, secured to the upper end 17 of the fixed attachment 10. Preferably, conventional bearings are provided for securing the pinion drive gear 18 to the fixed attachment 10.

A control console 41 is provided on an upper end 17 of the fixed attachment 10. The control console includes a control device 46 which designates how many fiber boxes should be loaded and active, thereby controlling density of material added to the material flow stream, and which is controlled by a control knob 46. In addition, it shows the LED status display 42 which indicates when a fiber box 60 has emptied and which fiber boxes 60 are still active. The LED status display 42 preferably has the LED status lights displayed in a circular pattern. In the center of the LED status display 42 is the System Status LED 44 which designates whether the fiber distribution ring 40 currently has loaded the correct number of functioning fiber boxes. There is a battery 43 which powers the LEDs. Whenever the number of fiber boxes designated are not available to stream fiber into the concrete stream, the center status LED will turn red and preferably sound an alarm. Preferably, the contacts 64 of the fiber boxes 60 on the fiber distribution ring 40 are connected to the control console 41 through a wireless connection, such that the control console 41 will correctly display the status of the fiber boxes 60 on the LED display 42. Preferably, a microprocessor based controller will control the wireless signal from the fiber distribution ring 40 corresponding to the status of the fiber 62 in respective ones of the fiber boxes 60. Similarly a microprocessor based controller within the control console 41 will selectively power the LED display 42 according to the fiber box status wireless signal received from the fiber distribution ring 40.

Figure 3:
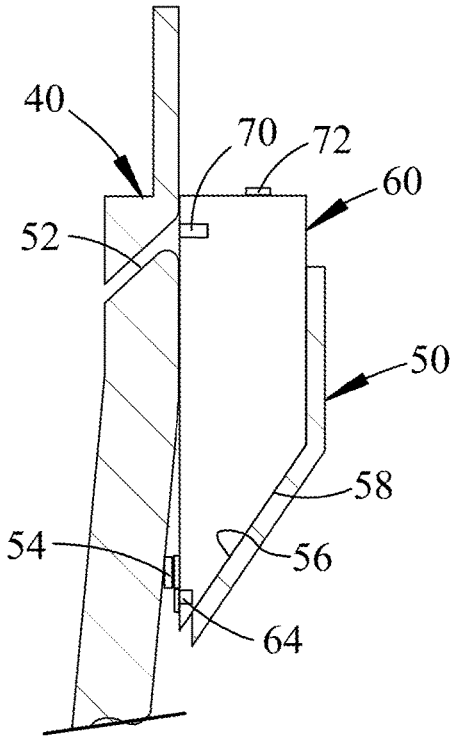

FIG. 3 is a partial section view of the fiber distribution ring 40, the fiber box holder 50 and the fiber box 60, taken along section line 3-3 of FIG. 1. A rapid attachment/release connector 33 is shown representing how part 40 is attached to fiber injector 8. The fiber aperture ports 52 through which the fiber streams are visible within the fiber box holders 50. The two contacts 54 at the bottom of each fiber box holder 50 must be completed by contacts 64 on the fiber box itself to enable the LED status light system 42 to recognize the fiber box as installed and loaded. The angled lower ends 58 of the boxes 60, when combined in cooperating relation with the angled interior surfaces 56 of the fiber box holder 50, are designed to force the contacts in the box 64 and the contacts 54 on the fiber distribution ring 40 to be intimate. Preferably, the retainer 72 is an elastomeric strap which pulls angled bottoms of the fiber boxes 62 against the angled bottom surface of the box holders 50. The fiber 62 is preferably streamed out of the fiber boxes 60 by contact with the concrete, or other material flow.

Figure 4:
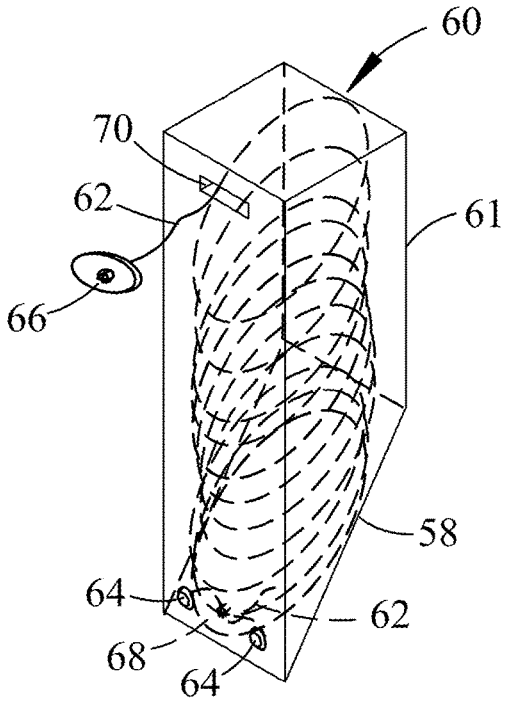

FIG. 4 is a perspective view of the fiber box 60. The fiber boxes 60 has an enclosure 61 which may be formed of various materials, such as metal, plastic or cardboard. The fiber 62 is preferably installed by winding the fiber 62 in horizontal loops, with the loops stacked on top of one another from the bottom to the top of a fiber box 60. A fiber install tab 66 is installed on an outward terminal end of the fiber 62, as delivered from the factory so that it can be installed easily through the fiber delivery aperture 52. A feed hole 70 extends through an upper end on an inward end surface of the fiber box 60 for passing the fiber 62. Fiber status contacts 64 are provided on the lower end of the inward end surface of the fiber box 60. An inward terminal end of the fiber 62 located on the end of the bottom loop is attached to a frangible conductor 68 which completes a status monitoring circuit so that when the fiber 72 comes to an end it pulls apart the frangible conductor 68 to open a monitoring circuit which provides an electric signal indicating that the fiber box 60 is empty of the fiber 62. The frangible conductor 68 is shown as a single wire extending between the two contacts 64. Preferably the contacts 64 are rivets formed of conductive material.

In other embodiments, a conductive coating may be placed on a frangible element which extends between the two contacts 64, such as paper coated with a conductive coating. The end of the fiber 62 may be secured to the frangible element with an adhesive, a rivet, or tied around the frangible element, such that pulling the fiber 62 on the frangible element will tear the frangible element and break electric conductivity between the two contacts 64.

Figure 6:
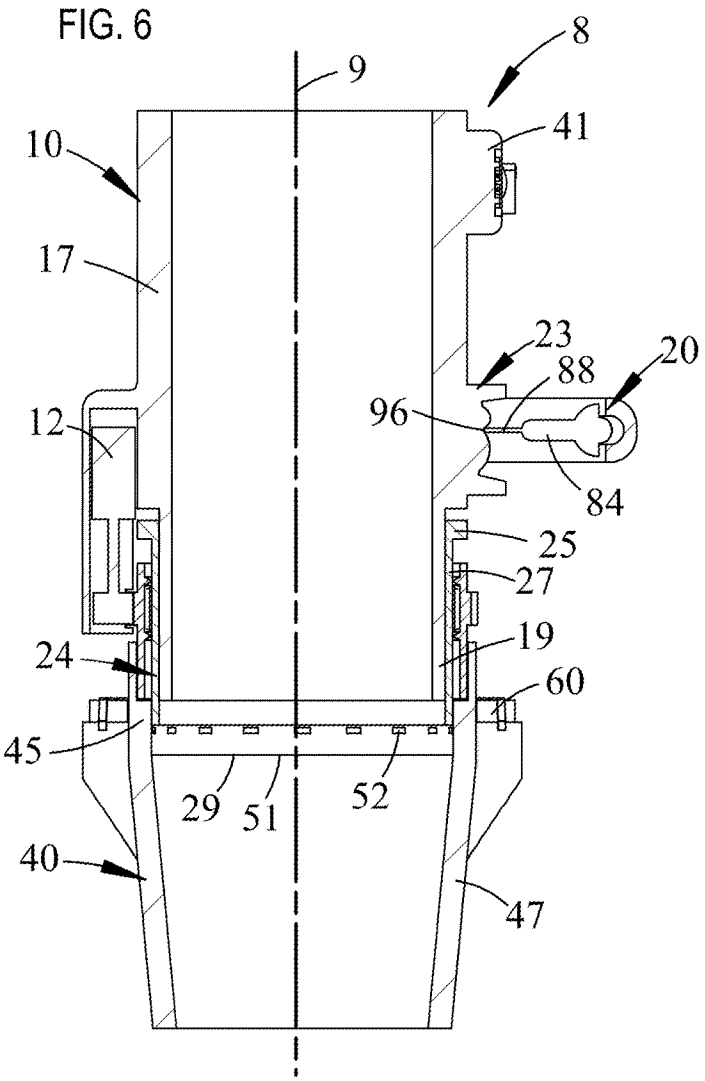
Figure 5:
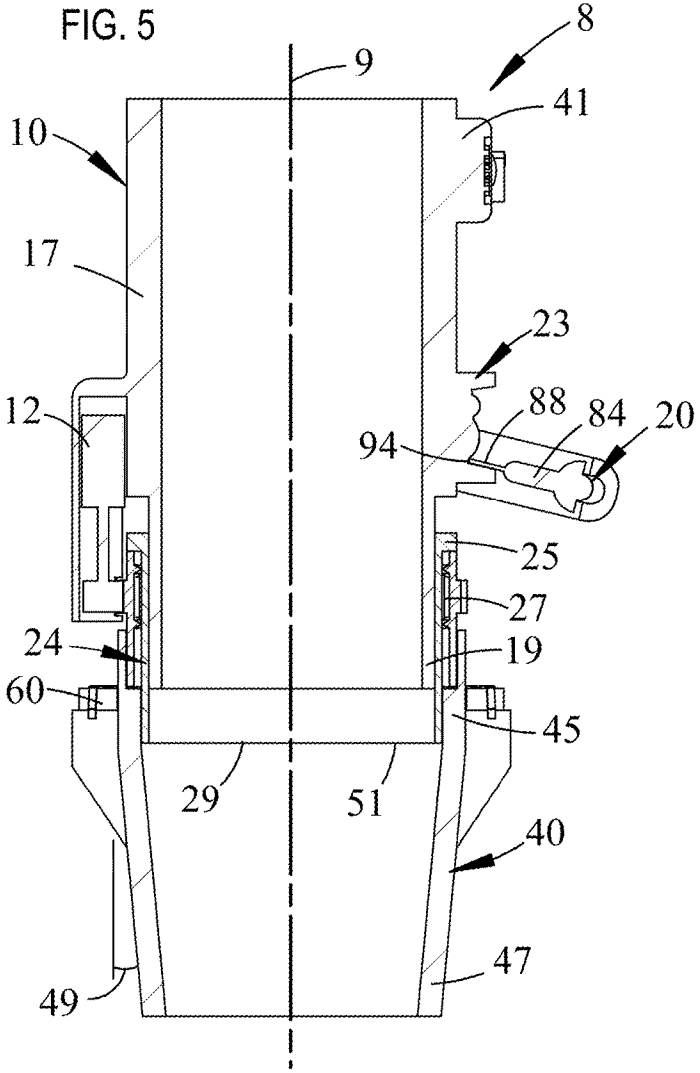
Figure 7:
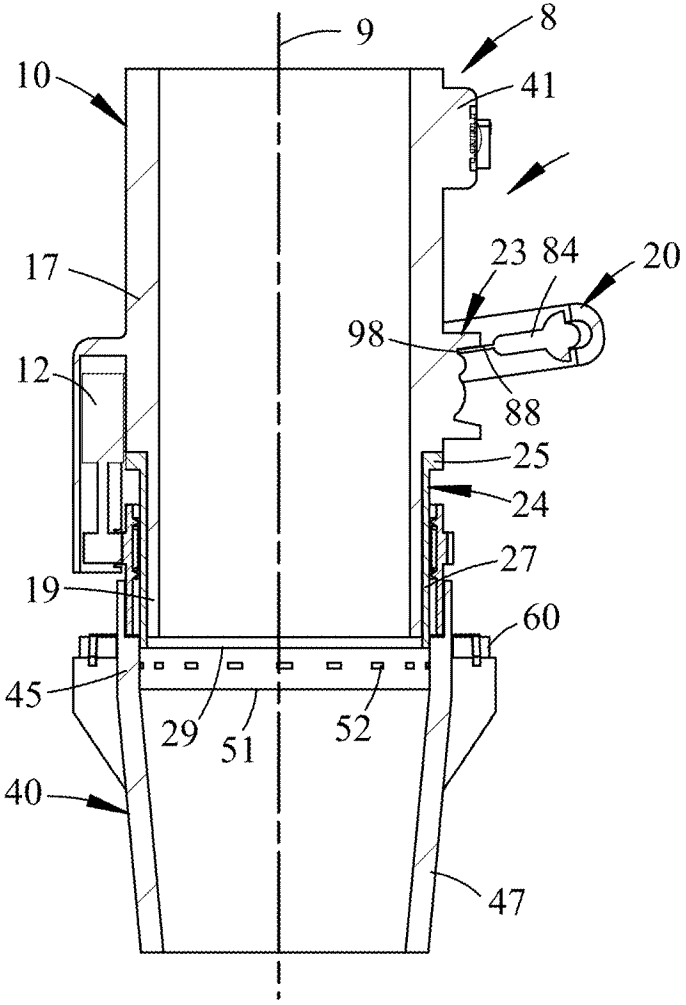

FIGS. 5, 6 and 7 are longitudinal section views of the fiber injector 8, taken along section line 5-5 of FIG. 1, and show operation of the control handle 20 for manually controlling operation the fiber injector 8. The control handle 20 has three positions via a lock positioner 23: a DOWN POSITION, a MIDDLE POSITION, and an UP POSITION.

FIG. 5 shows the control handle 20 in the DOWN POSITION, in which the fiber 62 is not streaming, and the rotary attachment 30 and the fiber distribution ring 40 are not rotating relative to the fixed attachment 10. The insert tab 88 of the lock pin 84 is engaged in the detent 94 of the lock positioner 23. In this position the brake actuator rod 26 has been pushed into a downward position, which moves the fiber brake 24 into a downward position in which the fiber brake 24 impinges on the fibers and blocks the fiber delivery apertures 52. In the downward position the fiber brake 24 has two purposes in that it blocks the fiber delivery apertures 52 so they do not become clogged by the concrete material stream while not in use and it blocks the fibers 62 from passing through the apertures 52 and being deposited into the material stream. With or without the fiber distribution ring 40 installed, if the control handle 20 is in the DOWN position, the device does not change the functionality of the boom delivery system at all and allows the control handle 20 to act as a manual concrete placement assist. The fiber distribution ring 40 has a tapered lower end 47 which tapers at an angle 49 to decrease in diameter slightly in a downward direction, such that lowering the fiber brake 24 blocks causes the body 27 of the fiber brake to cover the fiber apertures 52 and presses the lower rim 29 of the fiber brake 24 against the transition 51 region. This pinches the fibers 62 between the rim 29 and the sides of the distribution ring 40 at the transition region 51 to stop the fibers 62 from being injected into the material flow stream of concrete.

FIG. 6 shows the control handle 20 in the MIDDLE POSITION, with the insert tab 88 of the lock pin 84 engaged in the detent 96 of the lock positioner 23. In the MIDDLE POSITION the fiber brake 24 is raised to a lifted position, located above the fiber delivery apertures 52 so that the fibers 62 will pass through the apertures 52 and into the material flow stream. In the MIDDLE POSITION the switch 16 is not actuated, so that the rotary attachment 30 and the fiber distribution ring 40 are stationary and not rotating relative to the fixed attachment 10.

FIG. 7 shows the control handle 20 in an UP POSITION and the insert tab 88 of the lock pin 84 engaged in the detent 98 of the lock positioner 23. In the UP POSITION the fiber 62 is streaming and the rotary attachment 30 and the fiber distribution ring 40 are rotating. When the control handle 20 is raised to the UP POSITION the fiber brake 24 is raised above the fiber delivery apertures 52, freeing the fibers 62 to move from the fiber boxes 60 through the fiber delivery apertures 52 and into the fiber distribution ring 40. Raising the control handle 20 to the UP POSITION actuates the switch 16 which applies power to the electric motor 12 to rotate the rotary attachment 30 and the fiber distribution ring 40. The purpose of having the fibers 62 laid out with a rotational component is to allow laying down the fibers 62 that cross each other at regular intervals so as to distribute stresses across the field in an organized, regular fashion.

Figure 8:
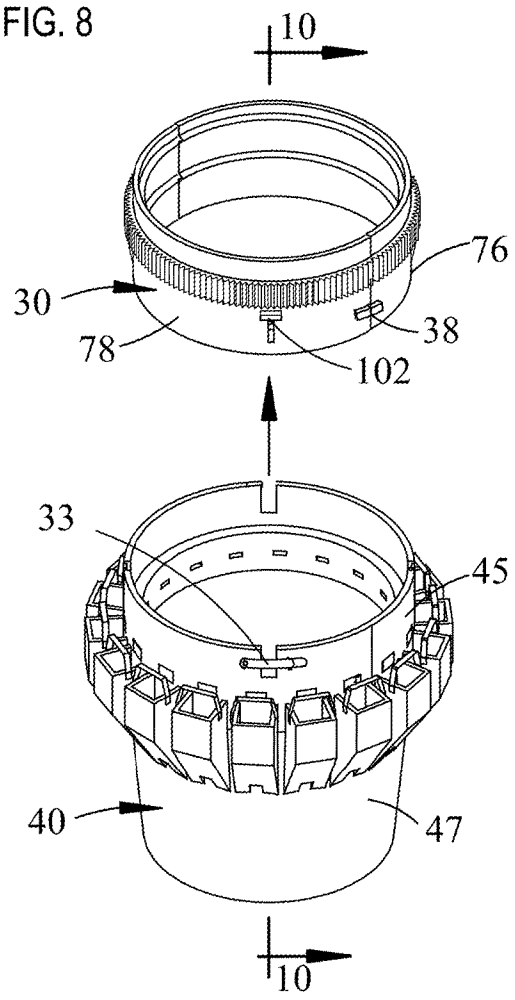

FIG. 8 is a partial exploded view showing the mounting of the fiber distribution ring 40 to the rotary attachment 30. Four rapid attachment release connectors 33 provide four catches 102 (one shown) which are provided on the rotary attachment 30 and four latches 112 which are provided on the fiber distribution ring 40, each preferably spaced apart equal angular distances about the longitudinal axis 9. The fiber catches 102 engage with respective ones of the latches 112 to secure the ring 40 to the rotary attachment 30.

Figure 9:
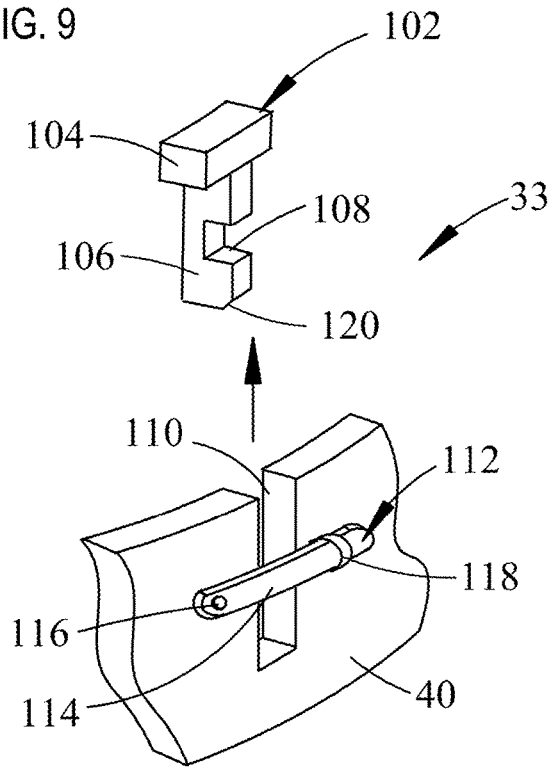

FIG. 9 is a partial perspective view showing a rapid attachment release connector 33 for releasibly locking the fiber distribution ring 40 to the rotary attachment 30. The connector 33 includes the catch 102 and the latch 112. A vertically extending slot 110 receives the length of the catch 102. The catch 102 includes a stop 104 and a catch body 106. The catch body 106 extends downward from the stop 104. A recess 108 extends through a central portion of the catch body 106. The latch 112 includes a lock arm 114 which provides a clasp for engaging in the recess 108 of the catch body 106. The lock arm 114 has a first end pivotally mounted to the fiber distribution ring 40 and a second end which is secured to the ring 40 by a hold down member. A tapered shoulder 120 provides a cam surface to assure the latch 112 will fit over the lower end of the catch body 106 to engage within the recess 108.

Figure 10:
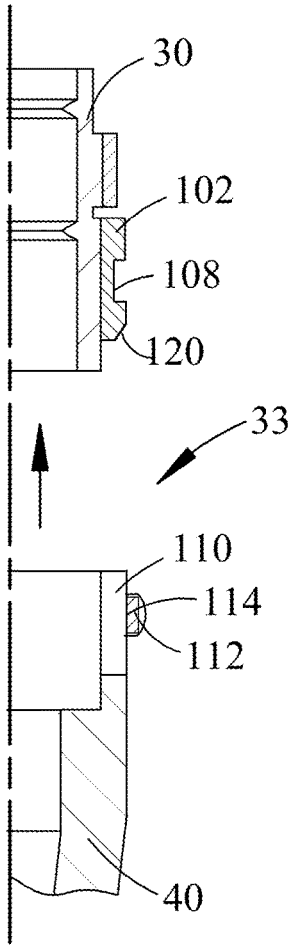
Figure 11:
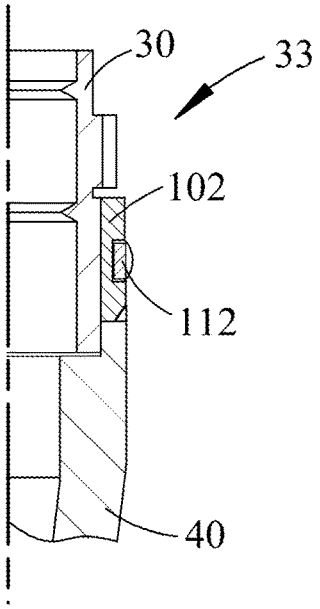

FIG. 10 is a partial section view showing mounting of the fiber distribution ring 40 to the rotary attachment 30 taken long section line 10-10 of FIG. 8, and FIG. 11 is a partial section view of the fiber distribution ring 40 mounted to the rotary attachment 30, also taken along section line 10-10 of FIG. 8. FIG. 10 shows the fiber distribution ring 40 being moved upward to engage the rotary attachment 30. The latch 118 will engage within the recess 108, as shown in FIG. 11.

Figure 12:
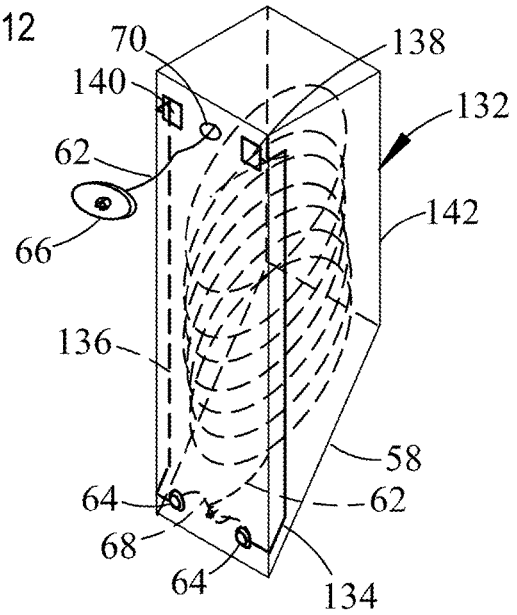

FIG. 12 is a perspective view of a second fiber box 132 which has several components that are similar to those described above for the fiber box 60 of FIG. 4. The fiber box 132 has electric contacts 138 and 140 provided by conductive lands or pads which are disposed on an outward surface at an upward end of the second fiber box 132. Conductive tracks 134 and 136 extend from the contacts 64 to the contacts 138 and 140. The frangible conductor 28 extends between the contacts 64, and is connected to the fiber 62.

Figure 13:
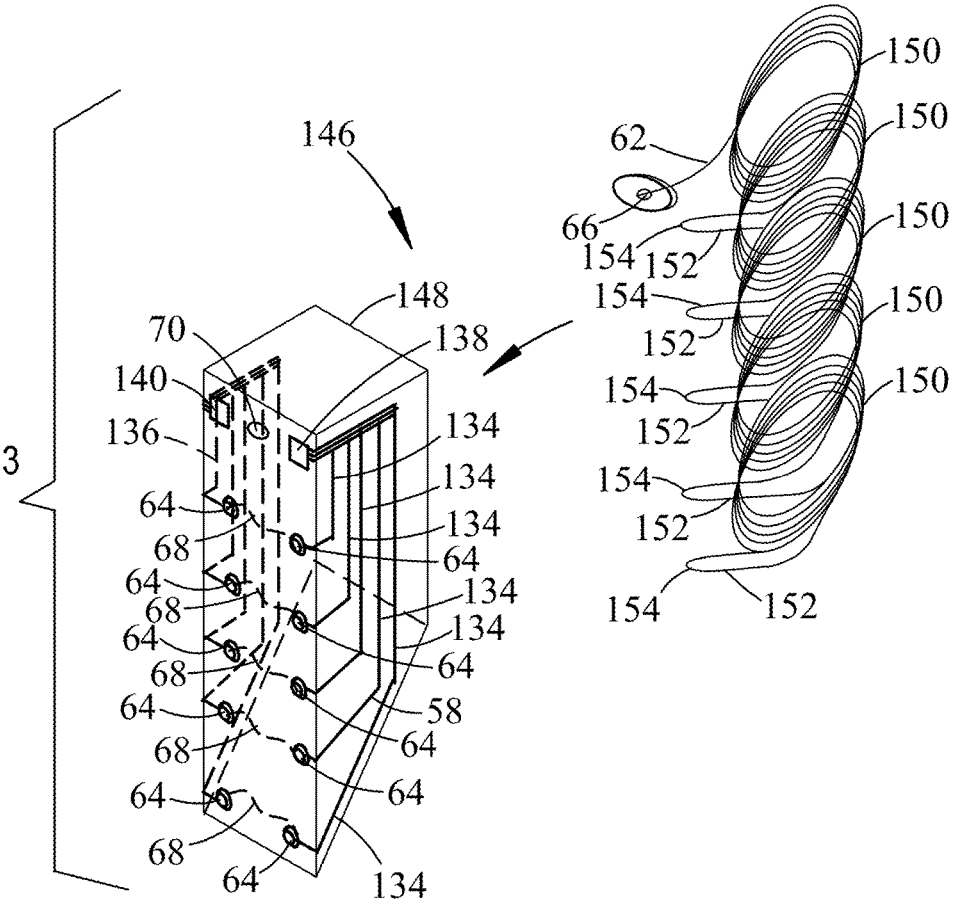

FIG. 13 is a partially exploded, perspective view of a third fiber box 146 having multiple frangible conductors 68 connected to external electric contacts 64 disposed at an outward surface of the third fiber box 146. The third fiber box 146 has an enclosure 148 within which a fiber 62 is disposed, preferably coiled into a plurality of coils. The fiber 62 is wound into separate coils 150 which are separated by intermediate sections 152. The intermediate sections 152 are formed to define connect loops 154. The frangible conductors 68 are preferably tied to the connect loops 154. The fiber 62 is dispensed from the enclosure 148 by feeding the fiber 62 through the feed hole 70, as discussed above. The coils 150 of the fiber 62 are partitioned by respective ones of the frangible conductors 68 being secured to the fiber 62 between the coils 150. The frangible conductors 68 will break as the fiber 62 is dispensed, providing an indication which may be monitored to determine the percentage of the fiber 62 has been dispensed from within the enclosure 148.

Figure 14:
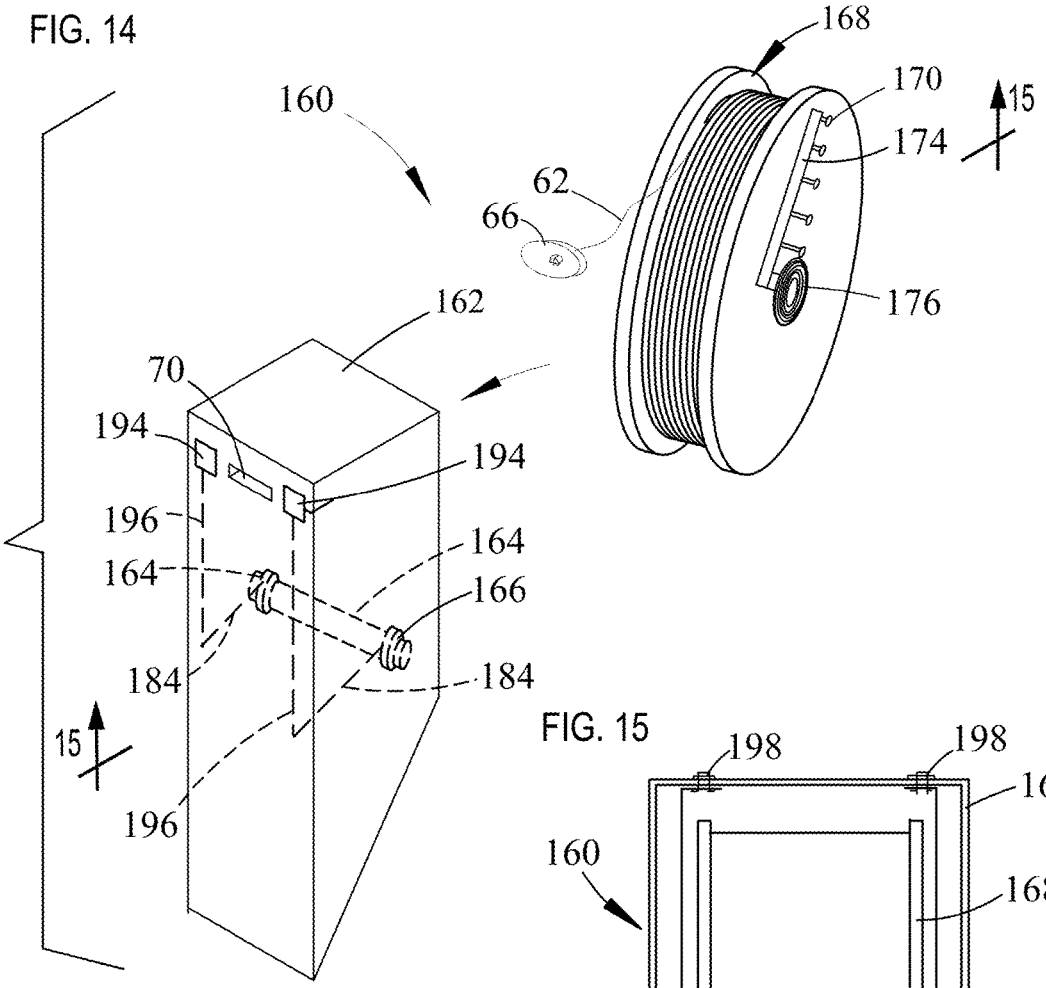
Figure 15:
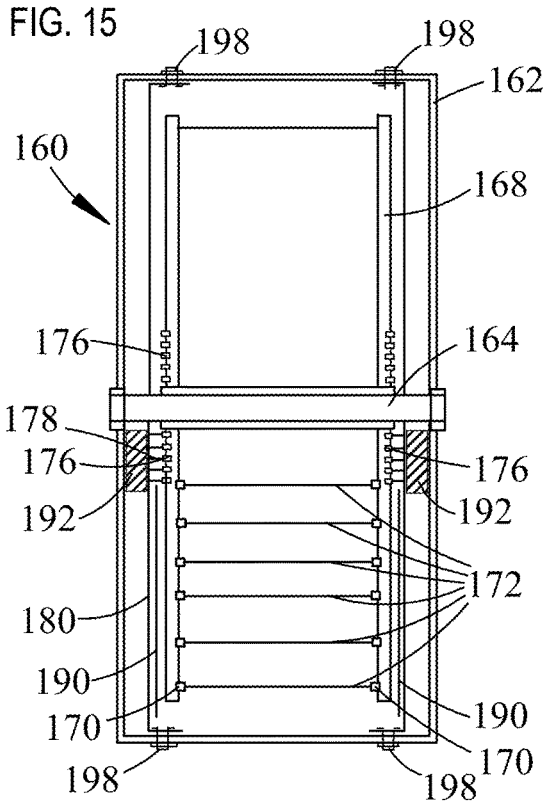

FIG. 14 is a partially exploded, perspective view and FIG. 15 is a sectional view taken along Section Line 15-15 of FIG. 14, showing a fourth fiber box 160 which includes an enclosure 162 and a reel 168. The reel 168 is mounted to a spindle pin 164 which is rotatably mounted to bushings 166. Preferably, a single continuous fiber 62 is spooled around the reel 168 for dispensing therefrom. The bushings 166 are mounted to the enclosure 162 at opposite ends of the spindle pin 164. The reel 168 has contact points 170 which are paired in registered alignment on opposite sides of the reel 168, with respective frangible conductors 172 extending between corresponding ones of the registered pairs of the contact points 170. The frangible conductors 172 are connected to the fiber 62 at different layers wrapped around the reel 168 and provide an indication that a known length, or other amount, of the fiber 62 has been spooled off from the reel 168 when continuity between opposed ones of the contact points 170 is broken by the frangible conductors being broken. Similar to the configuration shown for the wound fiber 62 shown in FIG. 13 and the frangible conductors 64, the fiber 62 is wound about the reel 168 such that the respective ones of frangible conductors 172 will break when known lengths of the fiber 62 are removed. Preferably, intermediate sections similar to intermediate sections 152 of FIG. 13 are provided form said wound fiber 62 having connect loops 154 which are connected to said frangible conductors 172 for breaking an electric circuit through said frangible conductors 172 when the respective intermediate section 152 and connect loop 154 is spooled from the reel 168.

Opposed sides of the reel 168 have conductive tracks 174 which are preferably printed traces that connect between the contact points 170 and respective ones of contact tracks 176 disposed on opposite sides of the reel 168. The contact tracks 176 are preferably extend with a circular shape and are printed on opposite sides of the reels 168, circumscribing a central rotational axis for the reel 168 and the spindle pin 164. Brushes 178 are conductive contacts which are mounted in stationary relation to the enclosure 162 and are biased with a spring-like force to press against the contact tracks 176 of the reel 168. In the preferred embodiment bias means for providing the spring-like force for pressing the brushes 178 against the contact tracks 176 in electrically conductive engagement is provided by two closed cell foam members 192. In other embodiments bias members may be provided by coil springs, leaf springs or the like rather than the closed cell foam members 192. The brushes 178 are preferably provided by metal staples pressed through brush card 180 to both electrically engage the contact tracks 176 and brush pads 182 formed on the brush card 180. The brushes 178 are connected by means of the conductive tracks 184 and the conductive tracks 196 to the fiber box contact pads 194, which will preferably engage with contact pads located on the fiber distribution ring 40 (shown in FIG. 7). The contact pads 194 are shown at an upper end of the fiber box 160 in FIG. 14, but in other embodiments may be located at a lower end of the fiber box 160, such as shown in FIG. 4 for the fiber box 60.

Figure 16:
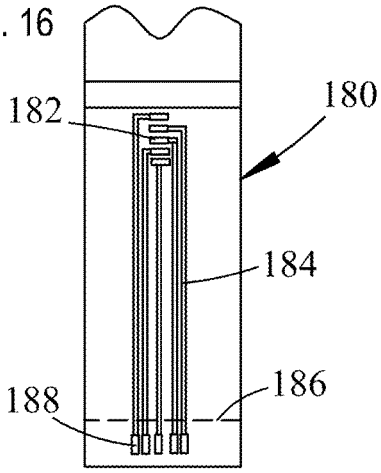

FIG. 16 is a layout plan view of a contact brush card 180 for mounting in the enclosure 162 of the fourth fiber box 160. The brush card 180 is preferably a flat sheet of material on which conductive brush pads 182, conductive tracks 184 and contact pads 188 are formed, preferably by printing conductive materials. Opposite ends of the brush card 180 have fold lines (one shown) for folding at a right angle to the main body for mounting the brush card 180 in the enclosure 162 as shown in FIG. 15. Preferably one or both opposite ends are stapled to the enclosure 162, with the staples 198 used on one side of the brush card 180 being conductive and passing through both the contact pads 188 of the brush card 180 and the circuit tracks 196 on the enclosure 162 to electrically connect respective ones of the brushes 178 to respective fiber box contact pads 194. A wear shield 190 is preferably applied to the surface of one side of the brush card 180 to cover the tracks 184 to prevent wear from abrasion should the reel press against the brush card 180 while rotating to spool the continuous fiber 62 from the reel 168.

Figure 17:
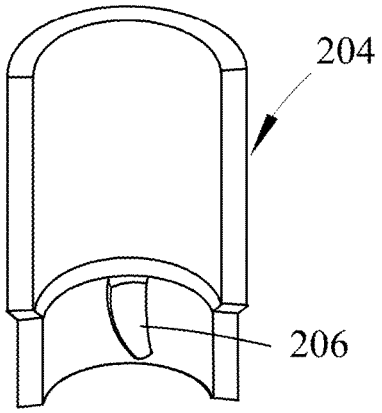
Figure 18:
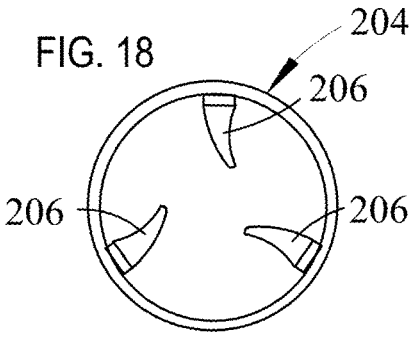

FIG. 17 is a longitudinal section view and FIG. 18 is a sectional view taken along section line 18-18 of FIG. 17 of an alternative fixed attachment 204 having interiorly disposed fixed impellers 206. The fixed impellers 206 are mounted in fixed relation to the interior surface of the fixed attachment 204 to impart rotation to a material flow stream passing through the fixed attachment 204 for alternate embodiments in which a fiber distribution ring 204 is not rotated relative to the fixed attachment 10 when dispensing fiber into the material flow stream, such as when the motor 12 is not powered in the embodiment of FIGS. 1-7. Imparting rotation of the material flow stream is provided to wrap the fiber being dispensed around the dispensed material of the material flow stream to form elongate lengths of fiber encased material. When dispensing concrete as the material in the flow stream, this is akin to creating elongate lengths of a fiber encasing a length of solid concrete mass for depositing into a form to cure and provide a structure.

Figure 19:
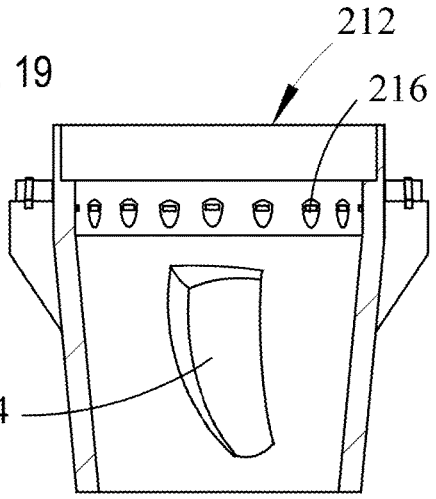

FIG. 19 is a longitudinal section view of an alternative fiber distribution ring 212 having interiorly disposed fixed impellers 214 (one shown). Preferably three or more of the fixed impellers 214 are provided, to provide the fiber distribution ring 212 with a cross-section similar to that shown in FIG. 18 for the fixed attachment 204. The fixed impellers 214 operate in similar fashion to the impellers 206 of FIGS. 17 and 18, to impart rotational movement of the material flow stream relative to the fiber delivery apertures 216 and encase the material flow in the fiber 62.

Figure 20:
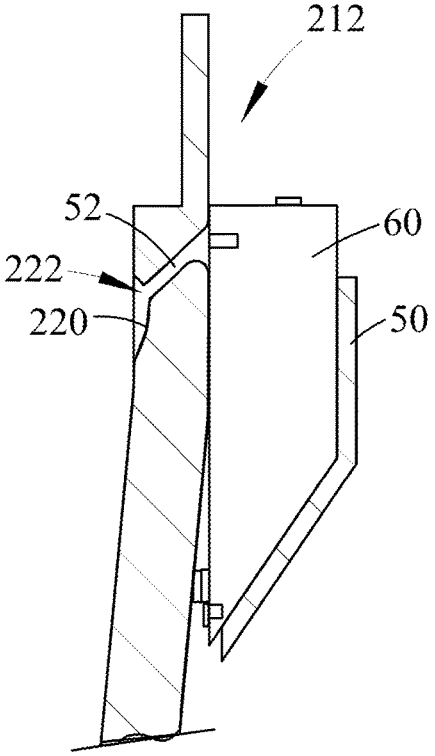
Figure 21:
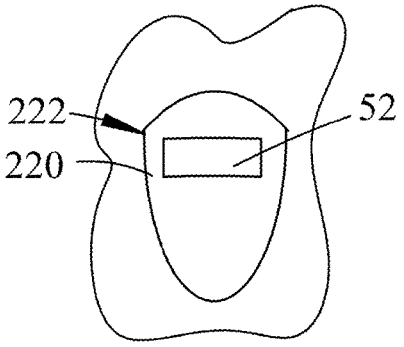

FIG. 20 is a partial section view of an alternative fiber distribution ring 212, a fiber box holder 50 and a fiber box 60, as would be viewed if taken along section line 3-3 of FIG. 1. FIG. 21 is an enlarged side elevation view of an interior surface of the fiber distribution ring of FIG. 20. Together FIGS. 20 and 21, which together show countersunk interior surfaces provided by a concave recess 220 providing scalloped region 222 disposed around the fiber delivery apertures 52. A plurality of scalloped regions 222 are shown as the fiber apertures 216 in FIG. 19. The scalloped regions 222 are preferably self-cleaning and allow the fiber 62 to easily pass into the material flow stream passing through the fiber distribution ring 212.

In typical usage, fiber injector 8 is affixed to the boom end of a delivery system, in this example a concrete pump. At the start, a fiber distribution ring 40 is fully loaded with the appropriate type and number of fiber boxes 60 attached to the fiber distribution ring 40 of the fiber injector 8. In general the fiber boxes 60 would be scaled to require no mid-service reloads. For example, the fiber boxes 60 would be scaled to complete a ten yard, or whatever is typical, load from a concrete truck, the used fiber distribution ring 40 is then snapped off and a new pre-loaded fiber ring would be installed and the next load would commence. In order to be most efficient, each system would have two fiber distribution rings 40 so that one could be loaded while the other is being used. The fiber boxes 60 would be pulled out, and the fiber end, fiber install tabs 66 of the new boxes 60 would be threaded though fiber apertures 52, the box inserted validating that the LED is active showing proper installation. After all the boxes 60, or whatever number of the boxes 60 required are loaded, the status LED registers green, then it is ready to be attached to fiber injector 8 for the next load.

In alternative embodiments, the LED status lights of the control console 31 may be mounted on the fiber distribution ring 40, and then a contacts 54 of the fiber box holders 50 may be connected directly to the LED Status lights 42 by hard wiring, to directly connect the contacts 64 of the fiber boxes 60. Other embodiments may use pneumatic or hydraulic components, such as for the motor 12, or for actuating operation of the fiber brake 24. For example, the brake actuator rod 26 may be replaced by a linear actuator, such as that operated by an electric solenoid, stepper motor, pneumatic actuator or hydraulic actuator, connected directly to the fixed attachment 10.

As the concrete is delivered to the deeper areas of the form, the fibers are delivered via either the rotational aspect, or directly without rotation. For example, the typical install for flatwork versus structural columns versus cantilevered structures will evolve. The type, number, and style of fiber application will be dependent and enhanced with further research. As the delivery approaches the upper finished inch, that is, the upper surface of the concrete being deposited, the handle will be put in the DOWN position, stopping the fiber injection, so that the final finished surface is without fibers protruding.

The present invention describes a new way to apply various materials in a quantitative way to pumpable materials, which is in this example concrete. While the current application is described using concrete pumps as an example, there is no reason it cannot be expanded to any number of applications.

The increase in utility of concrete due to the inclusion of more technically superior products, such as carbon graphite fibers, eventually graphene and carbon nanotubules, in such a uniform and quantifiable means controlled at the point of delivery has unlimited growth potential.

Although the preferred embodiment has been described in detail, it should be understood that various changes, substitutions and alterations can be made therein without departing from the spirit and scope of the invention as defined by the appended claims.

What is claimed is:

1. A fiber box for securing to a fiber injector for passing fiber into a material flow passing through a flow conductor and providing the fiber for injecting to the material flow, the fiber box comprising:

a fiber for injecting into the material flow;

an enclosure for containing said fiber for passing into the material flow;

an aperture providing a feed hole for passing said fiber from an interior of said enclosure to an exterior of said enclosure;

two contacts having ends disposed on a side of said enclosure, said ends being spaced apart for registering with mating contacts of the fiber injector;

a frangible element extending between said two contacts, said frangible element being conductive for providing electrical continuity between said two contacts; and a second end of said fiber being secured to said frangible element, such that when said fiber is withdrawn from within said enclosure said frangible element separates and breaks electrical continuity between said two contacts.

2. The fiber box according to claim 1, further comprising a plurality of contact sets in addition to said two contacts, said contact sets connected to further frangible elements to provide an indication of an amount of said fiber withdrawn from said enclosure, wherein said frangible elements are disposed in relation to intermediate sections of said fiber to break continuity between respective ones of said contact sets which indicates a proportionate amount of said fiber withdrawn from said enclosure.

3. The fiber box according to claim 2, wherein said plurality of contact sets are disposed on said side of said enclosure for registering with additional mating contacts of the fiber injector.

4. The fiber box according to claim 2, wherein said fiber is wound into coils which are laid one atop another within said enclosure with intermediate sections disposed between sets of said coils of said fiber, said intermediate sections defining connect loops which are secured to respective ones of said further frangible elements.

5. The fiber box according to claim 1, further comprising a reel rotatably mounted within said enclosure, wherein said fiber is wound about said reel for spooling from said reel and passing through said aperture and into said flow conductor for dispensing into the material flow, said frangible element being electrically connected to respective contact tracks which are engaged by brushes, and wherein said brushes are electrically connected to said two contacts.

6. The fiber box according to claim 5, further comprising a plurality of contact sets in addition to said two contacts, said contact sets connected to additional frangible elements for metering withdrawal of said fiber which is wound about said spool, wherein said frangible elements are disposed in relation to intermediate sections of said fiber for separating electrical continuity between respective contact sets which provides an indication of proportionate amounts of said fiber withdrawn from said enclosure when the respective intermediate sections are spooled from said reel, said additional frangible element being electrically connected to respective additional contact tracks which are engaged by additional brushes, and wherein said additional brushes are electrically connected to contacts mounted to said side of said enclosure.

7. The fiber box according to claim 6, further comprising a brush card having conductive tracks formed thereon, and brush contacts extend from said conductive tracks to define said brushes and said additional brushes, wherein said brush card is mounted interiorly within said enclosure.

8. The fiber box according to claim 7, wherein said brushes are defined by staples protruding from said brush card with one end of said staples electrically connected to said conductive tracks of said brush card.

9. The fiber box according to claim 1, further comprising:

a fiber install tab secured to said first end of said fiber, and sized for fitting through a fiber delivery aperture extending into said fiber injector and said material flow;

an angled lower end for cooperatively engaging with an angled interior surface for urging said two contacts to electrically engage with two mating contacts; and wherein said aperture providing said feed hole is disposed on an upper portion of a said side of said fiber box.

10. A fiber box for securing to a fiber injector for passing fiber into a material flow passing through a flow conductor and providing the fiber for injecting to the material flow, the fiber box comprising:

an enclosure for containing said fiber for passing into the material flow;

an aperture providing a feed hole for passing said fiber from an interior of said enclosure to an exterior of said enclosure;

a plurality of contacts having ends disposed on a side of said enclosure, said ends being spaced apart for registering with mating contacts of the fiber injector;

a plurality of frangible elements extending between respective ones of said contacts, said frangible element being conductive for providing electrical continuity between said two contacts; and a second end and intermediate portions of said fiber being disposed in operative relation to corresponding ones of said frangible elements, such that when said fiber is withdrawn from within said enclosure corresponding ones of said frangible elements separate and break electrical continuity between respective ones of said contacts, wherein said frangible elements are disposed in relative relation to said second end and said intermediate sections of said fiber to indicate of a proportionate amount of said fiber withdrawn from said enclosure.

11. The fiber box according to claim 10, wherein said fiber is wound into coils which are laid one atop another within said enclosure with intermediate sections disposed between sets of said coils of said fiber, said intermediate sections defining connect loops which are secured to respective ones of said frangible elements.

12. The fiber box according to claim 10, further comprising a reel rotatably mounted within said enclosure, wherein said fiber is wound about said reel for spooling from said reel and passing through said aperture and into said flow conductor for dispensing into the material flow, said frangible element being electrically connected to respective contact tracks which are engaged by brushes, and wherein said brushes are electrically connected to said two contacts.

13. The fiber box according to claim 12, further comprising a brush card having conductive tracks formed thereon, and brush contacts extend from said conductive tracks to define said brushes and said additional brushes, wherein said brush card is mounted interiorly within said enclosure.

14. The fiber box according to claim 13, wherein said brushes are defined by staples protruding from said brush card with one end of said staples electrically connected to said conductive tracks of said brush card.

15. The fiber box according to claim 10, further comprising:

a fiber install tab secured to said first end of said fiber, and sized for fitting through a fiber delivery aperture extending into said fiber injector and said material flow;

an angled lower end for cooperatively engaging with an angled interior surface for urging said two contacts to electrically engage with two mating contacts;

wherein said two contacts are disposed on a side of said fiber box; and wherein said aperture providing said feed hole is disposed on an upper portion of said side of said fiber box.

16. A fiber box for securing to a fiber injector for passing a single fiber into a material flow passing through a flow conductor, the fiber box comprising:

an enclosure for containing said single fiber for passing into the material flow;

an aperture providing a feed hole for passing said single fiber from an interior of said enclosure to an exterior of said enclosure;

a plurality of contacts having ends disposed on a side of said enclosure, said ends being spaced apart for registering with mating contacts of the fiber injector;

a plurality of frangible elements extending between respective ones of said contacts, said frangible element being conductive for providing electrical continuity between said two contacts; and a second end and intermediate portions of said single fiber being secured to corresponding ones of said frangible elements, such that when said single fiber is withdrawn from within said enclosure a corresponding one of said frangible elements separates and breaks electrical continuity between respective ones of said contacts, wherein said frangible elements are connected to said second end and said intermediate sections of said single fiber to provide an indication of a proportionate amount of said single fiber withdrawn from said enclosure.

17. The fiber box according to claim 16, wherein said single fiber is wound into coils which are laid one atop another within said enclosure with intermediate sections disposed between sets of said coils of said single fiber, said intermediate sections defining connect loops which are secured to respective ones of said frangible elements.

18. The fiber box according to claim 16, further comprising a reel rotatably mounted within said enclosure, wherein said single fiber is wound about said reel for spooling from said reel and passing through said aperture and into said flow conductor for dispensing into the material flow, said frangible element being electrically connected to respective contact tracks which are engaged by brushes, and wherein said brushes are electrically connected to said two contacts.

19. The fiber box according to claim 18, wherein said frangible elements are connected to intermediate sections of said fiber to provide a proportionate amount of said fiber withdrawn from said enclosure when the respective intermediate sections of said single fiber are spooled from said reel, said frangible elements being electrically connected to respective additional contact tracks which are engaged by additional brushes, and wherein said additional brushes are electrically connected to contacts mounted to said side of said enclosure.

20. The fiber box according to claim 19, further comprising:

a brush card having conductive tracks formed thereon, and brush contacts extend from said conductive tracks to define said brushes and said additional brushes, wherein said brush card is mounted interiorly within said enclosure;

said brushes are defined by staples protruding from said brush card with one end of said staples electrically connected to said conductive tracks of said brush card;

a fiber install tab secured to said first end of said single fiber, and sized for fitting through a fiber delivery aperture extending into said fiber injector and said material flow;

an angled lower end for cooperatively engaging with an angled interior surface for urging said two contacts to electrically engage with two mating contacts;

wherein said two contacts are disposed on a said side of said fiber box; and wherein said aperture providing said feed hole is disposed on an upper portion of said side of said fiber box.

* * * * *